US008320590B2

(12) United States Patent
Sungyoung

(10) Patent No.: US 8,320,590 B2
(45) Date of Patent: Nov. 27, 2012

(54) DEVICE, METHOD, PROGRAM, AND SYSTEM FOR CANCELING CROSSTALK WHEN REPRODUCING SOUND THROUGH PLURALITY OF SPEAKERS ARRANGED AROUND LISTENER

(75) Inventor: Kim Sungyoung, Hamamatsu (JP)

(73) Assignee: Yamaha Corporation (JP)

( * ) Notice: Subject to any disclaimer, the term of this patent is extended or adjusted under 35 U.S.C. 154(b) by 238 days.

(21) Appl. No.: 12/722,011

(22) Filed: Mar. 11, 2010

(65) Prior Publication Data

US 2010/0232609 A1 Sep. 16, 2010

(30) Foreign Application Priority Data

Mar. 11, 2009 (JP) ..... 2009-057762

(51) Int. Cl.
*H04R 5/02* (2006.01)
*H04R 5/00* (2006.01)

(52) U.S. Cl. ..... 381/307; 381/27

(58) Field of Classification Search ..... 381/27, 381/307

See application file for complete search history.

(56) References Cited

U.S. PATENT DOCUMENTS 5,610,986 A 3/1997 Miles

FOREIGN PATENT DOCUMENTS

JP 3322166 B2 9/2002
WO 98/58522 A2 12/1998

OTHER PUBLICATIONS

"Multichannel stereophonic sound system with and without accompanying picture", Recommendation ITU-R BS. 775-2, "online", "acquired through Internet search on Mar. 11, 2009", <URL: http://www.itu.int/rec/R-REC-BS.775-2-200607-I/en>; Cited in spec.

European Search Report issued in corresponding European Patent Application No. 10 00 2581 dated Jun. 7, 2010.

Cooper, Duane H., et al. "Prospects for Transaural Recording", Journal of the Audio Engineering Society, vol. 37, No. 1-2, New York, NY, Feb. 1, 1989, pp. 3-19.

*Primary Examiner* — Ping Lee

(74) *Attorney, Agent, or Firm* — Rossi, Kimms & McDowell LLP

(57) ABSTRACT

In an audio signal processing device, a signal input part receives a plurality of audio signals to be provided to a plurality of speakers, respectively, arranged so as to surround a listener, the speakers including a center speaker, a left speaker and a right speaker. A signal processing part adds a processed audio signal to an audio signal to be provided to the center speaker, the processed signal being obtained by attenuating a summation of audio signals to be provided to the left speaker and the right speaker. The signal processing part attenuates the summation of the audio signals by an attenuation rate which is set between 0 and 1. The signal processing part sets the attenuation rate to an appropriate value effective to suppress crosstalk between sound emitted from the left speaker and sound emitted from the right speaker.

14 Claims, 5 Drawing Sheets

DEVICE, METHOD, PROGRAM, AND SYSTEM FOR CANCELING CROSSTALK WHEN REPRODUCING SOUND THROUGH PLURALITY OF SPEAKERS ARRANGED AROUND LISTENER

BACKGROUND OF THE INVENTION

1. Technical Field of the Invention

The present invention relates to a technology that enables provision of 3 dimensional sound with a high feeling of presence or realism to a listener.

2. Description of the Related Art

Examples of a technology for providing 2 or 3-Dimensional (2D or 3D) sound with a high feeling of presence or realism include a so-called multichannel surround system. In the multichannel surround system, multiple speakers, which are arranged around a listener, emit sounds (so as to surround the listener) to provide a 2D or 3D sound with a high sense of presence or realism. International Telecommunication Union (ITU) has made recommendations as to the positions of arrangement of the speakers in such a multichannel surround system (see Non-Patent Reference 1). For example, for a system including 5 speakers, i.e., a center channel speaker C, a left front speaker L, a right front speaker R, a left surround speaker LS, and a right surround speaker RS, it is recommended that the speakers be arranged as shown in FIG. 4. In the following, the left front speaker L and the left surround speaker LS are commonly referred to as a "left channel speaker" or simply "left speaker" when there is no need to discriminate between the two channels and the right front speaker R and the right surround speaker RS are also commonly referred to as a "right channel speaker" or simply "right speaker" when there is no need to discriminate between the two channels.

The left front speaker L which is arranged at a front left side when viewed from the listener and the right front speaker R which is arranged at a front right side as shown in FIG. 4 are used to localize a sound image at the front left side, the center front side, or the front right side from the viewpoint of the listener. The left surround speaker LS and the right surround speaker RS, which will be collectively referred to as "surround speakers" in some cases, are arranged, respectively, at the left lateral side (or left rear side) and the right lateral side (or right rear side) of the listener and are used to reproduce a non-localized sound (for example, a sound such as speech coming out of nowhere) or a localized sound of a sound image of the lateral side or the rear side of the listener. The center channel speaker C arranged at the center front side of the listener is used to reproduce a sound localized at the front side such as a line of dialog of, for example, a drama or movie. A system (so-called 5.1 channel surround system) which includes a subwoofer responsible for mid and bass ranges in addition to the 5 speakers shown in FIG. 4 has also been widely used.

Sounds output from the speakers in the multichannel surround system described above not only include sounds recorded using a general microphone but also frequently include sounds recorded using a so-called dummy head. Accordingly, it is possible to provide a 3D sound with a high sense of presence or realism even though the speakers are arranged in 2 dimensions. Here, the term "dummy head recording" refers to a technology for receiving and recording sounds of microphones arranged respectively at positions of left and right ears of a human head model (i.e., a dummy head). In the following description, an output signal of a microphone at the left ear side of the dummy head is referred to as a "left dummy head signal DL" and an output signal of a microphone at the right ear side thereof is referred to as a "right dummy head signal DR".

However, a phenomenon which is called "crosstalk" may occur when the left and right speakers are driven by the dummy head signals. Here, the crosstalk is, for example, a phenomenon in which sound emitted from the speaker of the right channel travels around the head of the listener to reach the left ear EL of the listener (or, similarly, a phenomenon in which a sound emitted from the speaker of the left channel travels around the head of the listener to reach the right ear ER of the listener). Thus, a technology in which each dummy head signal is provided to each speaker after preprocessing is performed on the dummy head signal through a filtering process or the like to cancel the crosstalk has been suggested (for example, see Patent Reference 1).

RELATED ART REFERENCES

Patent References

[Patent Reference 1] Japanese Patent No. 3322166

Non-Patent References

[Non-Patent Reference 1] "Multichannel stereophonic sound system with and without accompanying picture", RECOMMENDATION ITU-R BS. 775-2, "online", "acquired through Internet search on Mar. 11, 2009", <URL: http://www.itu.int/rec/R-REC-BS.775-2-200607-I/en>

In the technology described in Patent Reference 1, to cancel crosstalk, there is a need to provide a special (electrical) structure for applying the preprocessing to an audio device (for example, a stereo mixer) that provides an audio signal to each speaker. However, a general audio device that is used for a home theater system or the like does not necessarily have such a structure and thus it is not always possible to directly apply the technology described in Patent reference 1. In the technology described in Patent Reference 1, a filter used for the preprocessing has a strong peak in its characteristics since the filter is a so-called inverse filter. Thus, there is a problem in that the tone color of a sound output from each speaker greatly varies due to the filtering. The variation of such tone color is particularly evident in a home theater system for the following reasons.

The technology described in Patent Reference 1 assumes the arrangement of speakers recommended in Non-Patent Reference 1 and thus cannot cancel crosstalk when speakers are arranged at different positions from the recommended arrangement positions. However, it is difficult to arrange speakers as is recommended in Non-Patent reference 1 in a home theater system that is actually arranged in a relatively small space such as a living room of the user. When speakers are arranged at different positions from the arrangement positions recommended in Non-Patent Reference 1, it is not possible to appropriately cancel crosstalk even using the technology described in Patent Reference 1 and thus the variation of tone color is remarkable as described above. This is the reason why the variation of such tone color is remarkable in a home theater system.

In the technology in which preprocessing is applied to an audio signal in order to cancel crosstalk as described above, there is a need to provide a special structure to the audio device that provides an audio signal to each speaker, and problems associated with speaker arrangement also easily occur as described above.

SUMMARY OF THE INVENTION

The invention has been made in view of the above problems and it is an object of the invention to provide a technology that can cancel crosstalk, when providing a 3D sound with a high sense of presence or realism using a plurality of speakers arranged around a listener, without providing a special structure to an audio device that provides an audio signal to each speaker, while limiting occurrence of problems due to speaker arrangement.

In order to solve the above problems, the invention provides an audio signal processing device comprising: a signal input part that receives a plurality of audio signals to be provided to a plurality of speakers, respectively, arranged so as to surround a listener, the speakers including a center speaker, a left speaker and a right speaker; and a signal processing part that adds a processed audio signal to an audio signal to be provided to the center speaker, the processed signal being obtained by attenuating a summation of audio signals to be provided to the left speaker and the right speaker. The invention further provides a signal processing method in which the audio signal to be provided to the center speaker is processed as described above, and a program causing a computer to perform the signal processing method.

As is described in detail later, the audio signal processing device, the audio signal processing method, and the program according to the invention acoustically cancel crosstalk by interference between a sound emitted from the speaker of the center channel and sounds emitted from the speakers of the left and right channels. Therefore, it is possible to alleviate crosstalk even when the respective speakers of the left channel, the center channel, and the right channel are arranged around the listener at unequal distances from the listener or when the arrangement positions of the speakers and the position of the listener are slightly different from those defined in Non-Patent Reference 1. In addition, the change of tone color is small since preprocessing for canceling crosstalk is not applied to the audio signals to be provided to the speakers of the left and right channels.

In order to solve the above problems, the invention also provides an audio system comprising: a plurality of speakers arranged so as to surround a listener, the speakers including a center speaker, a left speaker and a right speaker; and an audio signal processing device that receives from an external source a plurality of audio signals to be provided to the plurality of the speakers, respectively, that directly provides a first one of the plurality of the audio signals to the left speaker and directly provides a second one of the plurality of the speakers to the right speaker, and that provides a third one of the plurality of the audio signals to the center speaker after adding a processed audio signal to the third audio signal, the processed audio signal being obtained by attenuating a summation of the first audio signal and the second audio signal. The invention further provides a program causing a computer to perform the same processes as those of the audio signal processing device.

DETAILED DESCRIPTION OF THE INVENTION

Embodiments of the invention will now be described in detail with reference to the drawings.

A: First Embodiment

Figure 1:
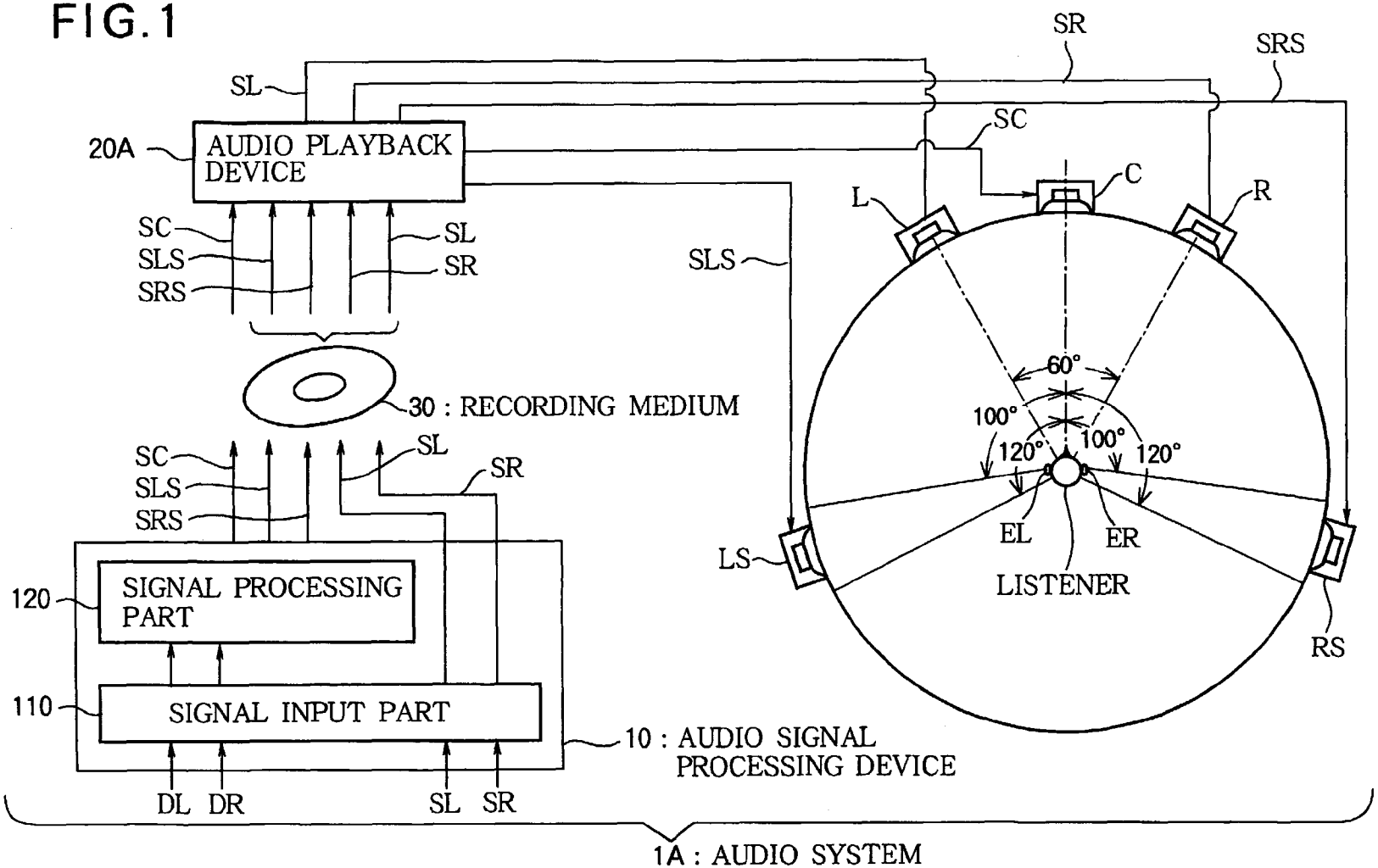
FIG. 1 illustrates an example configuration of an audio system according to a first embodiment of the invention.
Figure 4:
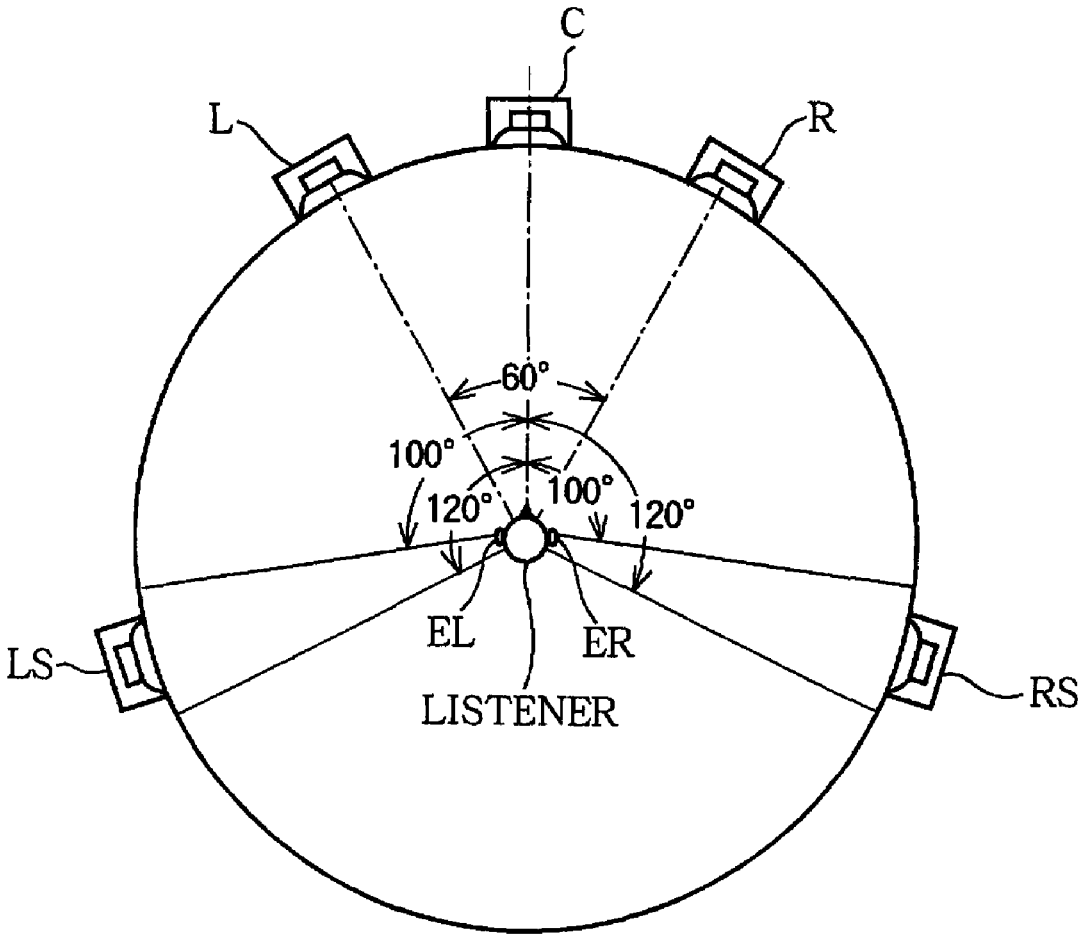
FIG. 4 illustrates an example of a multichannel surround system for providing a 3D sound to a listener.

FIG. 1 illustrates an example configuration of an audio system 1A according to a first embodiment of the invention. In FIG. 1, the same elements as those of FIG. 4 are denoted by the same reference numerals. As shown in FIG. 1, the audio system 1A is a multichannel surround system including the same 5 speakers as shown in FIG. 4. Each of the 5 speakers (i.e., the center channel speaker C, the left front speaker L, the right front speaker R, the left surround speaker LS, and the right surround speaker RS) is driven by audio signals provided from an audio playback device 20A and outputs sounds according to the audio signals.

The audio playback device 20A of FIG. 1 is an audio device of a playback system that is disposed together with the 5 speakers in a living room or the like of the user. The audio playback device 20A reads a center channel audio signal SC, a left front audio signal SL, a right front audio signal SR, a left surround signal SLS, and a right surround signal SRS from a recording medium 30 such as a Digital Versatile Disc (DVD), and provides the read signals to the 5 speakers as shown in FIG. 1. Here, the left front audio signal SL and the right front audio signal SR, which are output signals of general microphones, are used to localize a sound image at the front left side, the center front side, or the front right side when viewed from the listener. The left surround signal SLS and the right surround signal SRS are audio signals representing a non-localized sound or a sound image located at the rear side of the listener and are, in this embodiment, audio signals representing sounds recorded through a dummy head. The center channel audio signal SC is an audio signal that contains a processed signal serving to cancel crosstalk of sounds emitted from the surround speakers. Details of the center channel audio signal SC will be described later. A description of details of the configuration of the audio playback device 20A is omitted since the configuration thereof is identical to the configuration of a general storage medium reading device such as a general DVD player.

In addition, although this embodiment has been described with reference to the case where the left surround signal SLS and the right surround signal SRS are recorded through a dummy head, they may also be audio signals that are generated through separate signal processing and that represent sounds having the same characteristics as those of sounds recorded through the dummy head. For example, an audio signal of a sound generated from a sound source that the listener desires to localize around them may be convoluted with a head transfer function to convert the audio signal into audio signals of sounds heard by left and right ears of the listener and the converted audio signals may then be used in place of the audio signals of the sounds recorded through the dummy head. Namely, the audio signal processing device receives the audio signals to be provided to the left speaker and the right speaker, the received audio signals being obtained by convoluting original audio signals with a head transfer function to convert the original audio signals into the audio signals of sounds as if heard by left and right ears of the listener.

The audio signal processing device 10 of FIG. 1 is an audio device of a recording system that a recording engineer of, for example, a content provider such as a music record company uses. The audio signal processing device 10 writes a left front audio signal SL and a right front audio signal SR provided from an external source to the recording medium 30 and generates a center channel audio signal SC, a left surround signal SLS, and a right surround signal SRS from the left dummy head signal DL and the right dummy head signal DR provided from the external source and writes the three signals to the recording medium 30. The content provider distributes the recording medium 30 to which such signals are written as described above, and the user of the playback system purchases the recording medium 30 and reproduces music or the like recorded on the recording medium 30 using the playback system.

As shown in FIG. 1, the audio signal processing device 10 includes a signal input part 110 and a signal processing part 120. The signal input part 110 is a means for receiving the left front audio signal SL, the right front audio signal SR, the left dummy head signal DL, and the right dummy head signal DR provided from the external source. The external source is selected from various media. For example, in the case where such signals are provided through a communications line, a Network Interface Card (NIC) may be used as the signal input part 110. In the case where the signals are provided in a form written to a recording medium, for example, a recording medium reading device such as a DVD driver may be used as the signal input part 110. In addition, in the case where the signals are provided as output signals of microphones, pickups, or the like, the signal input part 110 may include input terminals connected to the microphones, the pickups, or the like.

Figure 5:
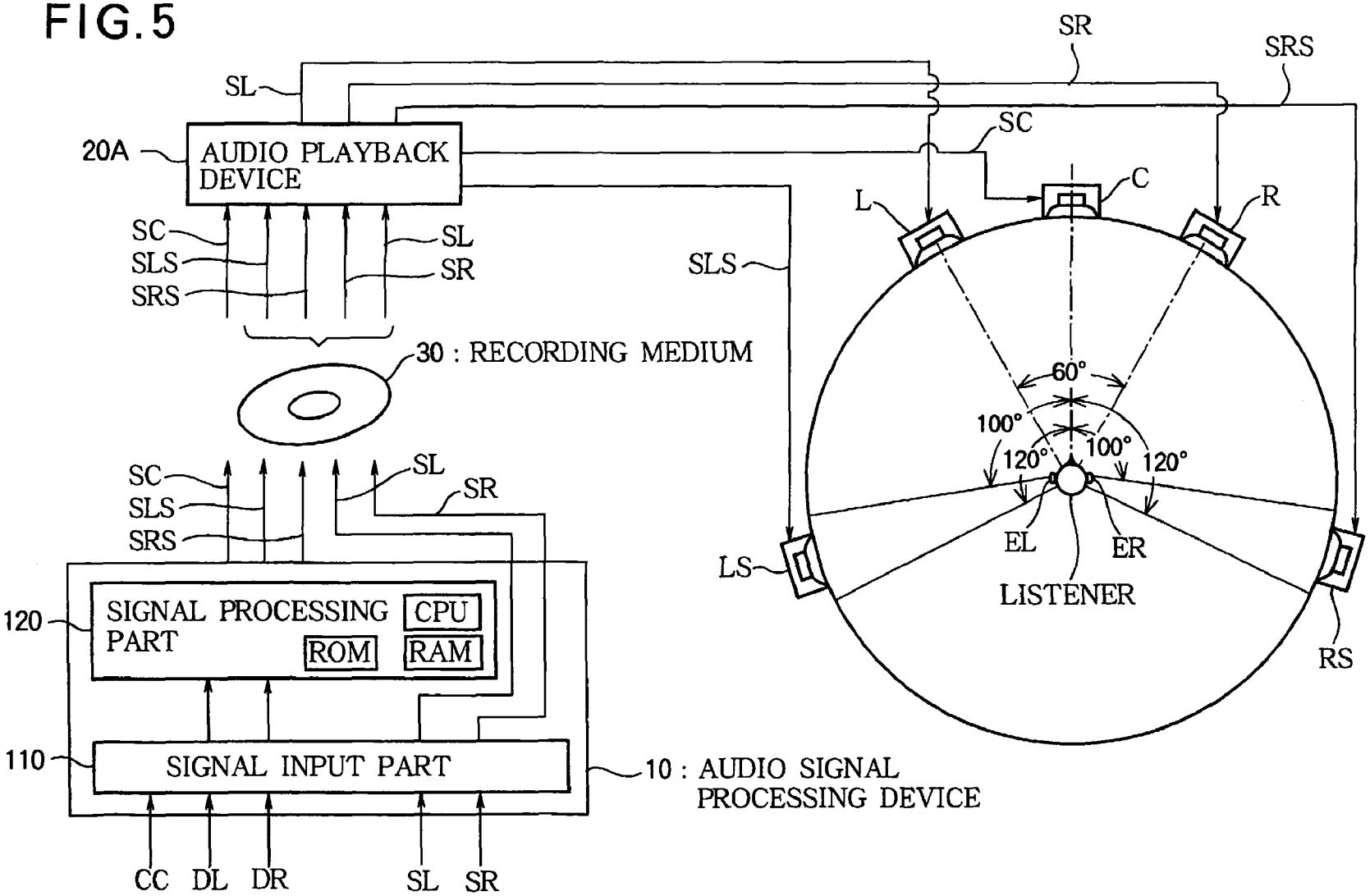
FIG. 5 illustrates a modification of the audio system of the first embodiment of the invention.

On the other hand, the signal processing part 120 includes a Central Processing Unit (CPU), a Random Access Memory (RAM), and a Read Only Memory (ROM) which are not shown in FIG. 1 but shown in FIG. 5. The ROM stores a program that causes the CPU to perform a signal generation process for generating the center channel audio signal SC, the left surround signal SLS, and the right surround signal SRS from the left dummy head signal DL and the right dummy head signal DR, and the RAM is used as a work area when the program is executed. More specifically, in the signal generation process, the left dummy head signal DL input through the signal input part 110 is output directly as the left surround signal SLS and the right dummy head signal DR input through the same is output directly as the right surround signal SRS. In the signal generation process, a signal obtained by attenuating a summation of the left dummy head signal DL and the right dummy head signal DR at an attenuation rate of $\alpha(0<\alpha<1)$, i.e., a signal calculated according to the following Equation (1), is output as the center channel audio signal SC. The reason why the signal processing part 120 generates these three signals will become apparent later.

$$SC=-\alpha\times(DL+DR) \tag{1}$$

Of the 5 audio signals that the audio signal processing device 10 writes to the recording medium 30, the left front audio signal SL and the right front audio signal SR are identical to the signals that are provided to the left and right speakers in the conventional multichannel surround system shown in FIG. 4. On the other hand, the left surround signal SLS and the right surround signal SRS are different from those described in Patent Reference 1 in that the left surround signal SLS and the right surround signal SRS are the same as the left dummy head signal DL and the right dummy head signal DR, respectively. Crosstalk may occur if the speakers are driven by dummy head signals to which preprocessing such as a filtering process has not been applied as described above. However, this embodiment is characterized in that the center channel audio signal SC is driven by the center channel audio signal SC containing a processed signal calculated according to Equation (1) so that crosstalk is acoustically canceled by interference between sounds output from the left surround speaker LS and the right surround speaker RS and a sound output from the center channel audio signal SC. As understood from the above description, the left surround speaker LS corresponds to the claimed left speaker ad the right surround speaker RS corresponds to the claimed right speaker in the above described embodiment.

The following is a description of the reason why crosstalk can be canceled by driving the center channel speaker C by the center channel audio signal SC calculated according to Equation (1) in the case where the left surround speaker LS is driven by the left dummy head signal DL without change thereof and the right surround speaker RS is driven by the right dummy head signal DR without change thereof.

Figure 2:
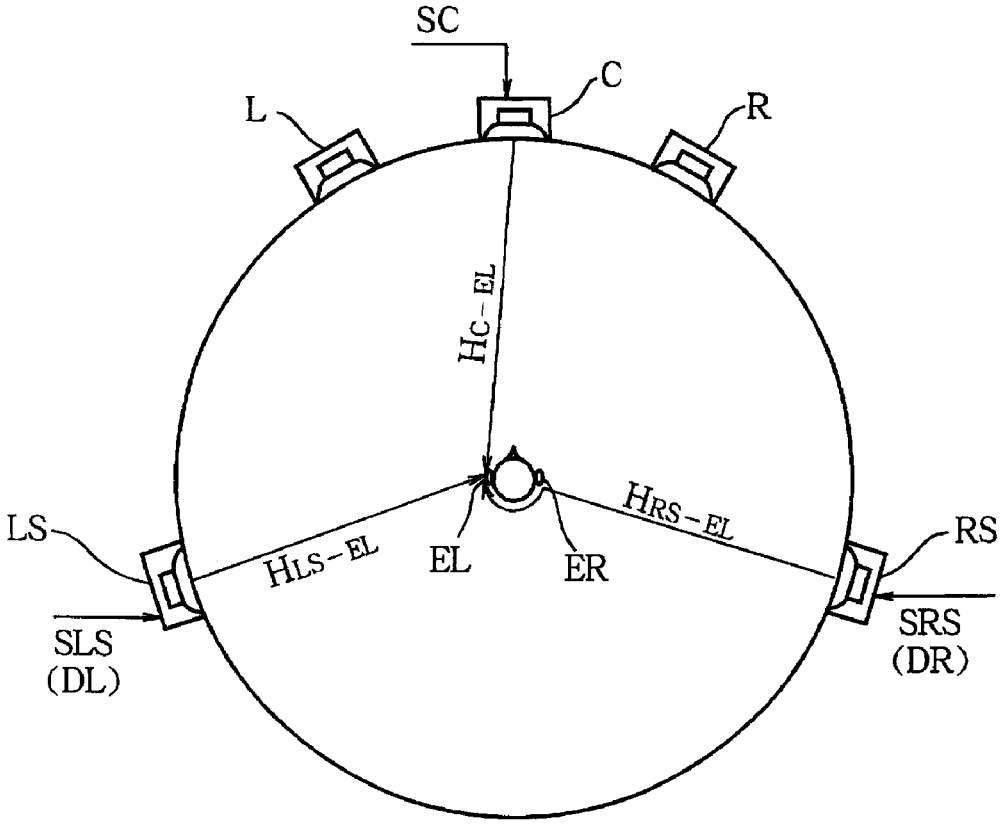
FIG. 2 illustrates an example propagation path of a sound in the audio system.

FIG. 2 schematically illustrates a propagation path along which a sound output from the center channel speaker C travels until it reaches the left ear EL of the listener and a transfer function $H_{C\text{-}EL}$ thereof, a propagation path along which a sound output from the left surround speaker LS travels until it reaches the left ear EL of the listener and a transfer function $H_{LS\text{-}EL}$ thereof, and a propagation path along which a sound output from the right surround speaker RS travels around the head of the listener until it reaches the left ear EL of the listener and a transfer function $H_{RS\text{-}EL}$ thereof. A left surround signal SLS, which is identical to the left dummy head signal DL, is provided to the left surround speaker LS, a right surround signal SRS, which is identical to the right dummy head signal DR, is provided to the right surround speaker RS, and a signal represented by the following Equation (2), which is obtained by attenuating a summation of the dummy head signals at an attenuation rate of T (>0) is provided to the center channel speaker C. In this case, a sound heard by the left ear EL of the listener is represented by the following Equation (3). Here, the sign of T is expressed as "minus" for the sake of convenience.

$$-T\times(DL+DR) \tag{2}$$

$$H_{LS\text{-}EL}\times DL+H_{RS\text{-}EL}\times DR-T\times H_{C\text{-}EL}\times(DL+DR)= (H_{LS\text{-}EL}-T\times H_{C\text{-}EL})\times DL+(H_{RS\text{-}EL}-T\times H_{C\text{-}EL})\times DR \tag{3}$$

Here, the second term of the right-hand side of Equation (3), which corresponds to the components of the sound according to the right dummy head signal DR, should be zero in order to prevent generation of crosstalk near the left ear EL of the listener. The transfer functions $H_{RS\text{-}EL}$ and $H_{C\text{-}EL}$ and the attenuation rate T should satisfy a relation of the following Equation (4). Equation (5) is obtained by rearranging Equation (4) with respect to T.

$$H_{RS\text{-}EL}-T\times H_{C\text{-}EL}=0 \tag{4}$$

$$T=H_{RS\text{-}L}/H_{C\text{-}EL} \tag{5}$$

Alternatively, the attenuation rate T can be calculated according to the equation $T=H_{LS\text{-}ER}/H_{C\text{-}ER}$ in manner analogous to the equation (5).

On the other hand, when Equation (5) is substituted into the first term of the right-hand side of Equation (3), the first term of the right-hand side of Equation (3) is rearranged into the following Equation (6).

$$(H_{LS\text{-}EL}-H_{RS\text{-}EL})\times DL \quad (6)$$

In Equation (6), $H_{LS\text{-}EL}$ can be considered equal to about 1 since $H_{LS\text{-}EL}$ is the transfer function of the propagation path along which the sound from the left surround speaker LS travels until it reaches the left ear EL. On the other hand, $H_{RS\text{-}EL}$ can be considered as being sufficiently low compared to $H_{LS\text{-}EL}$ is the transfer function of the propagation path along which the sound from the right surround speaker RS travels around the head of the listener as described above. That is, Equation (6) can be considered as being nearly equal to DL. Accordingly, Equation (3) is nearly equal to DL.

A sound represented by the left dummy head signal DL is heard by the left ear EL of the listener shown in FIG. 2 if a sound according to the signal calculated according to Equations (2) and (5) is output through the center channel speaker C with a sound according to the left dummy head signal DL being output through the left surround speaker LS and a sound according to the right dummy head signal DR being output through the right surround speaker RS as described above.

Here, since the transfer functions $H_{C\text{-}EL}$ and $H_{RS\text{-}EL}$ of the right-hand side of Equation (5) are functions of frequency, the attenuation rate T calculated according to Equation (5) is also a function of frequency. As described above, $H_{C\text{-}EL}$ is the transfer function of the propagation path along which a sound from the center channel speaker C travels until it reaches the left ear of the listener (i.e., the transfer function of a sound coming from the front side when viewed from the listener) and $H_{RS\text{-}EL}$ is the transfer function of the propagation path along which a sound output from the right surround speaker RS travels around the rear part of the head of the listener until it reaches the left ear of the listener. When detailed characteristics of the frequency response of $H_{C\text{-}EL}$ and $H_{RS\text{-}EL}$ are neglected, generally, the transfer function (specifically, the approximate value of the amplitude of the frequency response) of the sound that travels around is sufficiently small compared to the transfer function (specifically, the approximate value of the amplitude of the frequency response) of the direct sound from the front side (i.e., $H_{C\text{-}EL} \geqq H_{RS\text{-}EL}$). Therefore, the absolute value of the right-hand side of Equation (5) is in a range from 0 to 1. That is, when detailed characteristics of the frequency response of the transfer functions $H_{C\text{-}EL}$ and $H_{RS\text{-}EL}$ are neglected (namely, when the phase relation of the transfer functions $H_{C\text{-}EL}$ and $H_{RS\text{-}EL}$ are neglected), T in Equation (2) can be regarded as a constant number in a range of 0 to 1 and an equation obtained by replacing T in Equation (2) with the constant value $\alpha$ in the range between 0 and 1 is the above Equation (1).

That is, crosstalk can be nearly (or mostly) canceled by providing the center channel speaker C with the center channel audio signal SC that contains a processed signal calculated according to Equation (1) by appropriately setting the attenuation rate $\alpha$ in the range of 0 to 1 with a sound according to the left dummy head signal DL being output through the left surround speaker LS and a sound according to the right dummy head signal DR being output through the right surround speaker RS. The attenuation rate $\alpha$ may be optimally set to an appropriate value at which it is determined that crosstalk is nearly canceled by listening, at the position of the listener shown in FIG. 1, to sounds from the speakers arranged as shown in FIG. 1 while changing the value of the attenuation rate $\alpha$ from 0 to 1. It can also be seen from FIG. 2 that crosstalk does not occur near the right ear ER of the listener since the speaker arrangement of this embodiment is horizontally symmetrical with respect to a straight line that passes, as a symmetric axis, through the center channel speaker C and the listener.

Here, it should be noted that the left surround speaker LS is driven by the left dummy head signal DL and the right surround speaker RS is driven by the right dummy head signal DR in this embodiment. In the technology described in Patent Reference 1, the speakers of the left and right channels are driven by dummy head signals to which preprocessing has been applied through filtering and thus there is a problem in that the tone color varies depending on the preprocessing. However, this embodiment does not have this problem since the surround speakers are driven by dummy head signals to which no processing has been applied. In addition, the center channel speaker C, the left surround speaker LS, and the right surround speaker RS are arranged about the listener at nearly equal distances from the listener. Therefore, while it is possible to acoustically cancel crosstalk satisfactorily by interference of sounds output from these three speakers, it is also possible to alleviate crosstalk when the three speakers C, LS, and RS are arranged at unequal intervals or when the speakers or the listener are arranged at slightly different positions from those defined in Non-Patent Reference 1.

According to this embodiment, it is possible to nearly cancel crosstalk without providing a special structure to the audio device (specifically, the audio playback device 20A) of the playback system that provides an audio signal to each speaker and also to provide a 3D sound with a high sense of presence or realism while avoiding the problems caused by the speaker arrangement such as tone color change. Accordingly, even when speakers cannot be arranged as recommended in Non-Patent Reference 1 or when an electrical structure for canceling crosstalk is not provided to the audio playback device 20A, the user of the audio playback device 20A can enjoy a 3D sound with a high sense of presence or realism and with an original tone color while crosstalk is nearly canceled. On the other hand, the recording engineer of the content provider can provide an audio signal that enables the user to enjoy a 3D sound with a high sense of presence or realism and with an original tone color while crosstalk is nearly canceled by performing a simple operation for appropriately setting the attenuation rate $\alpha$.

B: Second Embodiment

Figure 3:
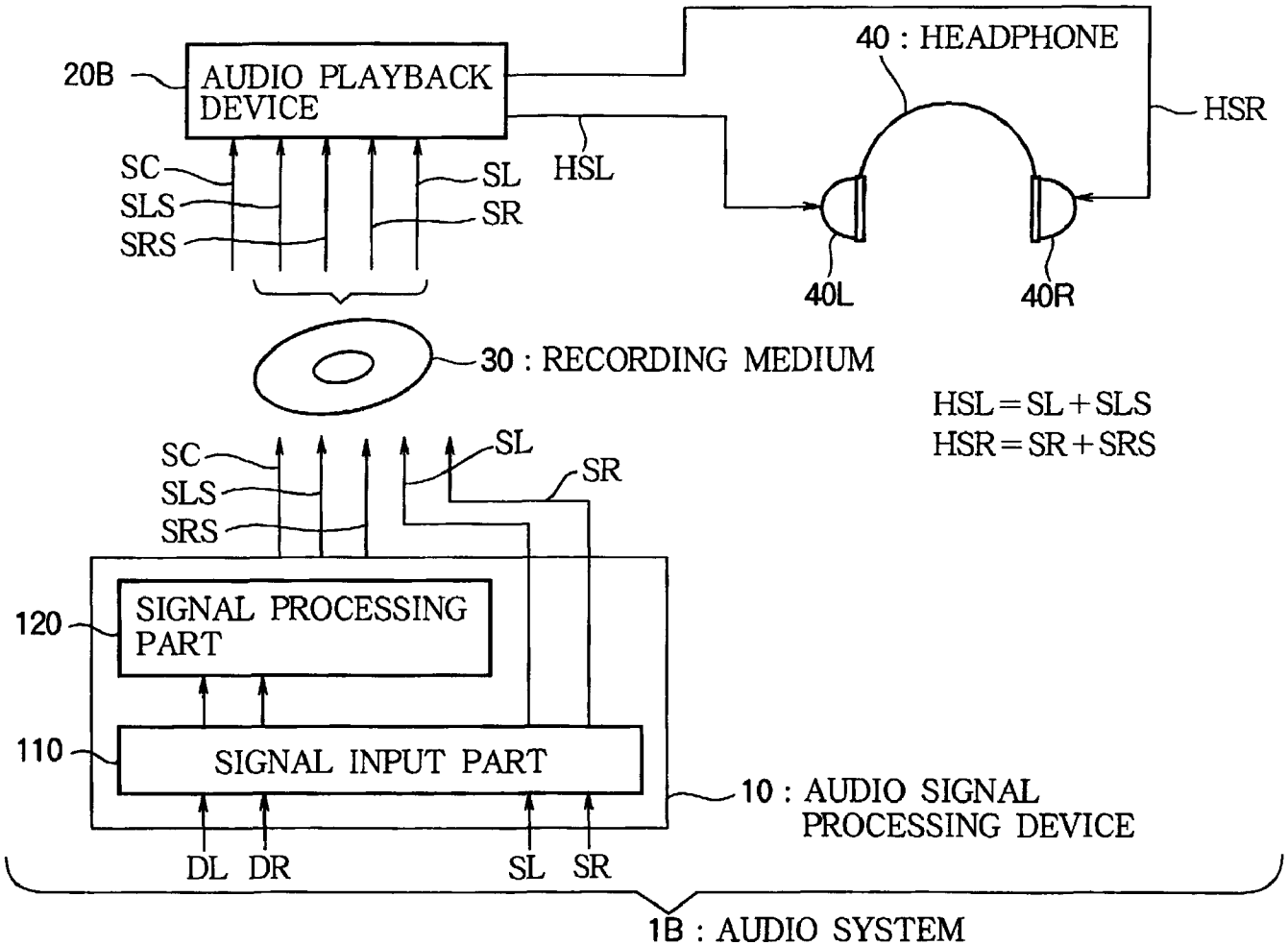
FIG. 3 illustrates an example configuration of another audio system according to a second embodiment of the invention.

FIG. 3 illustrates an example configuration of an audio system 1B according to a second embodiment of the invention. As is understood by comparing FIG. 3 with FIG. 1, the audio system 1B differs from the audio system 1A in that a headphone 40 is provided instead of the 5 speakers and that an audio playback device 20B is provided instead of the audio playback device 20A. The following description will be given, mainly focusing on the differences (i.e., the audio playback device 20B and the headphone 40) from the audio system 1A.

The audio playback device 20B reads a left front audio signal SL, a right front audio signal SR, a left surround signal SLS, and a right surround signal SRS among 5 types of audio signals written to the recording medium 30 and generates and provides a signal HSL represented by the following Equation (7) to a left ear side speaker 40L of the headphone 40, and generates and provides a signal HSR represented by the following Equation (8) to a right ear side speaker 40R of the headphone 40.

$$HSL=SL+SLS \quad (7)$$

$$HSR=SR+SRS \quad (8)$$

The left front audio signal SL and the right front audio signal SR are audio signals for localizing a sound image at the front left side, the center front side, or the front right side of the listener as described above. On the other hand, the left surround signal SLS and the right surround signal SRS are identical to a left dummy head signal DL and a right dummy head signal DR, respectively, and represent a sound image of the rear side of the listener or a non-localized sound. By listening to sounds output from the left ear side speaker 40L and the right ear side speaker 40R according to the audio signals represented by Equations (7) and (8), the listener wearing the headphone 40 can perceive a sound image localized at the front left side, the center front side, or the front right side, and a sound image localized at the rear side of the listener or a non-localized sound.

The audio system using a headphone inherently does not have the crosstalk problem. However, it should be noted that the audio signals provided to the speakers of the headphone 40 can be generated through calculation according to Equations (7) and (8). This is because the left surround signal SLS and the right surround signal SRS that the audio signal processing device 10 writes to the recording medium 30 are equal to the left dummy head signal DL and the right dummy head signal DR, respectively.

If audio signals HSL and HRS to be provided respectively to the left ear side speaker 40L and the right ear side speaker 40R are generated according to Equation (7) or Equation (8) using a surround signal to which preprocessing has been applied in order to cancel crosstalk, tone color changes in direct proportion to the degree of applied preprocessing. Therefore, in the case where crosstalk is canceled by applying preprocessing using a filtering process, it is necessary to individually prepare both the audio signals to be provided to the speakers of the multichannel surround system shown in FIG. 1 and the audio signals to be provided to the speakers of the headphone. On the other hand, since it is possible to generate the audio signals for the head phone speakers by directly using the audio signals prepared for the multichannel surround system, this embodiment has an advantage in that there is no need to individually prepare both the audio signals for surround speaker system and headphone system.

C: Other Embodiments

Although the embodiments of the invention have been described, the following modifications may also be made to the embodiments.

(1) In the first embodiment, the invention is applied to the multichannel surround system including the 5 speakers, i.e., the center channel speaker C, the left front speaker L, the right front speaker R, the left surround speaker LS, and the right surround speaker RS. However, the invention may also be applied to a 5.1-channel multichannel surround system including a subwoofer in addition to the 5 speakers. The number of surround speakers is not limited to one surround speaker for each of the left and right rear sides and the invention may also be applied to a system including N surround speakers for each of the left and right sides, where N is a natural number greater than 1.

(2) The above embodiments have been described with reference to the case where the left surround speaker LS and the right surround speaker RS are driven by respective dummy head signals to cancel crosstalk of sounds output from these two surround speakers. However, crosstalk of sounds output from the left front speaker L and the right front speaker R may also be acoustically canceled by interference with a sound output from the center channel speaker C. In summary, an audio signal obtained by attenuating a summation or combination of audio signals provided to the respective speakers of the left and right channels among a plurality of speakers arranged around the listener may be provided to the speaker of the center channel.

(3) FIG. 5 shows a modification of the first embodiment shown in FIG. 1. The first embodiment has been described with reference to the case where the audio signal provided to the center channel speaker C is not received from the outside. However, as shown in FIG. 5, in the case where an audio signal representing a line of dialog or the like of, for example, a movie as an audio signal CC for driving the center channel speaker C is provided to the audio signal processing device 10 from the outside, the center channel audio signal SC may be generated by adding an audio signal, obtained by attenuating a summation of audio signals DL and DR applied to the speakers LS and RS of the left and right channels, to the audio signal CC provided from the outside.

(4) Although, in the first and second embodiments, the audio playback device 20A (or the audio playback device 20B) receives audio signals from the audio signal processing device 10 through a recording medium, the audio signals may also be received through a communications line. In addition, in the audio signal processing device shown in FIG. 1, the audio signal processing device 10 may also directly provide audio signals to the speakers.

(5) Although the process for generating the center channel audio signal SC from the left dummy head signal DL and the right dummy head signal DR according to Equation (1) is implemented by software, the process may also be implemented by hardware. Specifically, the signal processing part 120 may be constructed of a DSP that performs calculation according to Equation (1).

(6) Although, in the above embodiments, detailed characteristics of the frequency response of the transfer functions $H_{C\text{-}EL}$ and $H_{RS\text{-}EL}$ are neglected and the center channel audio signal SC is calculated by replacing the attenuation rate T calculated according to Equation (5) with the constant value $\alpha$ in the range of 0 to 1, the center channel audio signal SC may also be calculated according to Equations (2) and (5). Crosstalk can also be nearly canceled using the center channel audio signal SC calculated according to Equation (1) as described above. However, if the center channel audio signal SC is calculated strictly by additionally using the detailed characteristics of the transfer functions $H_{C\text{-}EL}$ and $H_{RS\text{-}EL}$ of the right-hand side of Equation (5), it can be expected that crosstalk is canceled with higher accuracy although the amount of processing required for the calculation is increased. Of course, the attenuation rate T (constant $\alpha$) may be set for each of divided frequency bands. In this case, a negative value may also be set as the attenuation rate T (constant $\alpha$). In this embodiment, by designing the setting of the attenuation rate T (constant $\alpha$) of each frequency band, it can be expected to achieve both an increase in the accuracy of cancellation of crosstalk and a suitable amount of processing.

(7) In the first and second embodiments, the program causing the CPU of the signal processing part 120 to perform the process for generating the center channel audio signal SC from the left dummy head signal DL and the right dummy head signal DR according to Equation (1) has been previously stored in the ROM of the signal processing part 120 as shown in FIG. 5. However, the program may be distributed through a machine-readable recording medium such as a Compact Disc-Read Only Memory (CD-ROM) to which the program is written and may also be distributed through downloading via an electric communications line such as the Internet. By causing a general computer to operate according to the program distributed in this manner, it is possible to cause a general computer to perform the same processes as those of the audio signal processing device 10.

What is claimed is:

1. An audio signal processing device for processing audio signals provided to a plurality of speakers arranged to surround a listener, including a center speaker, a left-front speaker, a right-front speaker, a left-surround speaker, and a right-surround speaker, the audio signal processing device comprising:

a signal input part adapted to receive a plurality of audio signals from an external source; and a signal processing part adapted to output a processed audio signal to be provided to the center speaker, the processed audio signal being obtained by attenuating a summation of a left-surround audio signal, among the received plurality of audio signals, to be provided to the left-surround speaker and a right-surround audio signal, among the received plurality of audio signals, to be provided to the right-surround speaker, wherein the signal processing part is further adapted to:

directly output a left audio signal, among the received plurality of audio signals, to be provided to the left front speaker;

directly output a right audio signal, among the received plurality of audio signals, to be provided to the right front speaker;

directly output the left-surround audio signal to be provided to the left-surround speaker; and directly output the right-surround audio signal to be provided to the right-surround speaker.

2. The audio signal processing device according to claim 1, wherein the signal processing part is further adapted to attenuate the summation of the left audio signal to be provided to the left-surround speaker and the right audio signal to be provided to the right-surround speaker by an attenuation rate, which is settable between 0 and 1.

3. The audio signal processing device according to claim 2, wherein the attenuation rate T is calculated according to an equation $T=H_{RS-EL}/H_{C-EL}$ or $T=H_{LS-ER}/H_{C-ER}$, where $H_{RS-EL}$ denotes a transfer function from the right-surround speaker to a left ear of the listener, $H_{C-EL}$ denotes a transfer function from the center speaker to the left ear of the listener, $H_{LS-ER}$ denotes a transfer function from the left-surround speaker to a right ear of the listener, and $H_{C-ER}$ denotes a transfer function from the center speaker to the right ear of the listener.

4. The audio signal processing device according to claim 1, wherein the signal processing part is further adapted to set the attenuation rate between 0 and 1, effective to suppress crosstalk from the left-surround speaker to a right ear of the listener and from the right-surround speaker to a left ear of the listener.

5. The audio signal processing device according to claim 1, wherein the signal processing part is further adapted to add a center audio signal, among the received plurality of audio signals, to the processed audio signal and output an added result of the center audio signal and the processed audio signal to be provided to the center speaker.

6. The audio signal processing device according to claim 1, wherein:

the left-surround audio signal to be provided to the left-surround speaker, is collected by the external source, which includes a microphone attachable to a left ear of a dummy head, and the right-surround audio signal to be provided the right speaker is collected by the external source, which includes another microphone attachable to a right ear of the dummy head.

7. The audio signal processing device according to claim 1, wherein the left-surround and right-surround audio signals to be provided to the left-surround speaker and the right-surround speaker are obtained by convolving original audio signals with a head transfer function to convert the original audio signals into the left-surround and right-surround audio signals of sounds as if heard by left and right ears of the listener.

8. An audio signal processing method comprising the steps of:

receiving, from an external source, a plurality of audio signals to be provided to a plurality of speakers, respectively, arranged so as to surround a listener, the speakers including a center speaker, a left-front speaker, a right-front speaker, a left-surround speaker, and a right-surround speaker;

outputting a processed audio signal to be provided to the center speaker, the processed audio signal being obtained by attenuating a summation of a left-surround audio signal, among the received plurality of audio signals, to be provided to the left-surround speaker and a right-surround audio signal, among the received plurality of audio signals, to be provided to the right-surround speaker;

directly outputting a left audio signal, among the received plurality of audio signals, to be provided to the left front speaker;

directly outputting a right audio signal, among the received plurality of audio signals, to be provided to the right front speaker;

directly outputting the left-surround audio signal to be provided to the left-surround speaker; and directly outputting the right-surround audio signal to be provided to the right-surround speaker.

9. The audio signal processing method according to claim 8, further comprising the steps of:

adding a center audio signal, among the received plurality of audio signals, to the processed audio signal; and outputting an added result of the center audio signal and the processed audio signal to be provided to the center speaker.

10. A non-transitory machine readable medium readable by a computer, the medium containing a program executable by the computer to perform a method comprising the steps of:

receiving, from an external source, a plurality of audio signals to be provided to a plurality of speakers, respectively, arranged so as to surround a listener, the speakers including a center speaker, a left-front speaker, a right-front speaker, a left-surround speaker, and a right-surround speaker;

outputting a processed audio signal to be provided to the center speaker, the processed audio signal being obtained by attenuating a summation of a left-surround audio signal, among the received plurality of audio signals, to be provided to the left-surround speaker and a right-surround audio signal, among the received plurality of audio signals, to be provided to the right-surround speaker;

directly outputting a left audio signal, among the received plurality of audio signals, to be provided to the left front speaker;

directly outputting a right audio signal, among the received plurality of audio signals, to be provided to the right front speaker;

directly outputting the left-surround audio signal to be provided to the left-surround speaker; and directly outputting the right-surround audio signal to be provided to the right-surround speaker.

11. The non-transitory machine readable medium according to claim 10, wherein the method further comprises the steps of:

adding a center audio signal, among the received plurality of audio signals, to the processed audio signal; and outputting an added result of the center audio signal and the processed audio signal to be provided to the center speaker.

12. An audio system comprising:

a plurality of speakers arranged so as to surround a listener, the speakers including a center speaker, a left-front speaker, a right-front speaker, a left-surround speaker, and a right-surround speaker; and an audio signal processing device comprising:

a signal input part adapted to receive a plurality of audio signals from an external source; and a signal processing part adapted to output a processed audio signal to be provided to the center speaker, the processed audio signal being obtained by attenuating a summation of a left-surround audio signal, among the received plurality of audio signals, to be provided to the left-surround speaker and a right-surround audio signal, among the received plurality of audio signals, the right-surround speaker, wherein the signal processing part is further adapted to:

directly output a left audio signal, among the received plurality of audio signals, to be provided to the left front speaker;

directly output a right audio signal, among the received plurality of audio signals, to be provided to the right front speaker;

directly output the left-surround audio signal to be provided to the left-surround speaker; and directly output the right-surround audio signal to be provided to the right-surround speaker.

13. The audio system according to claim 12, wherein the signal processing part is further adapted to add a center audio signal, among the received plurality of audio signals, to the processed audio signal and output an added result of the center audio signal and the processed audio signal to be provided to the center speaker.

14. The audio system according to claim 12, wherein:

the left-surround audio signal to be provided to the left-surround speaker is collected by the external source, which includes a microphone attachable to a left ear of a dummy head, and the right-surround audio signal to be provided the right speaker is collected by the external source, which includes another microphone attachable to a right ear of the dummy head.

* * * * *